US006498960B1

(12) United States Patent
Uramoto

(10) Patent No.: US 6,498,960 B1
(45) Date of Patent: Dec. 24, 2002

(54) RECEIVER FOR DIGITAL AUDIO BROADCAST

(75) Inventor: Yoichi Uramoto, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/487,676

(22) Filed: Jan. 20, 2000

(30) Foreign Application Priority Data

Feb. 1, 1999 (JP) ..... 11-023486

(51) Int. Cl.[7] ..... G06F 17/00; H03K 9/00; H04L 27/06

(52) U.S. Cl. ..... 700/94; 375/316; 455/186.1; 381/2

(58) Field of Search ..... 700/94; 381/2, 381/104; 375/316, 324, 340, 345, 344; 455/186.1, 186.2

(56) References Cited

U.S. PATENT DOCUMENTS 5,796,785 A * 8/1998 Spiero ..... 375/316
6,115,473 A * 9/2000 Takagi ..... 381/2
6,144,707 A * 11/2000 Yoshida et al. ..... 375/316
6,201,837 B1 * 3/2001 Okamoto ..... 375/316
6,278,751 B1 * 8/2001 Uramoto ..... 375/345
6,341,123 B1 * 1/2002 Tsujishita et al. ..... 375/344
2002/0046329 A1 * 4/2002 Song ..... 711/157

FOREIGN PATENT DOCUMENTS

EP 0855793 * 1/1998
JP 11330998 A * 11/1999

* cited by examiner

*Primary Examiner*—Xu Mei
(74) *Attorney, Agent, or Firm*—Jay H. Maioli

(57) ABSTRACT

A receiver for receiving a digital audio broadcast by which digital audio data and incidental control data are sent out includes a reception circuit for receiving the digital audio broadcast, a decoder circuit for extracting the digital audio data and the control data from a signal received by the reception circuit, a D/A converter for performing D/A conversion of the thus extracted digital audio data into an analog audio signal and outputting the analog audio signal, a controller for controlling a characteristic of the analog audio signal in accordance with the extracted control data, and a memory into which the one of the digital audio data and the control data which had been extracted at an earlier time by the decoder circuit is written. The controller successively varies a write address for the memory in a sampling period of the digital audio data while it successively reads out the data written in the memory with a read address having a predetermined address difference from the write address and uses the data thus read out to execute control of the characteristic of the analog audio signal with the extracted control data to correct the time difference between the digital audio data and the control data.

3 Claims, 4 Drawing Sheets

ADDRESS (16 HEXADECIMAL)
MPEG AUDIO DATA
FFF MD(-n-1)
FFE MD(-n-2)
FFD MD(-n-3)
800+n+1 MD(-2047)
800+n MD(0)
800+n-1 MD(-1)
800+n-DA+1 MD(-DA+1)
800+n-DA MD(-DA)
800+n-DA-1 MD(-DA-1)
802 MD(-n+2)
801 MD(-n+1)
800 MD(-n)
WRITE ADDRESS
DA(=0)
READ ADDRESS
18

ADDRESS (16 HEXADECIMAL)
DRC DATA
7FF DD(-n-1)
7FE DD(-n-2)
7FD DD(-n-3)
n+1 DD(-2047)
n DD(0)
n-1 DD(-1)
n-DB+1 DD(-DB+1)
n-DB DD(-DB)
n-DB-1 DD(-DB-1)
2 DD(-n+2)
1 DD(-n+1)
0 DD(-n)
DIRECTION OF ADDRESS VARIATION
800h
WRITE ADDRESS
DB(=336)
READ ADDRESS
34

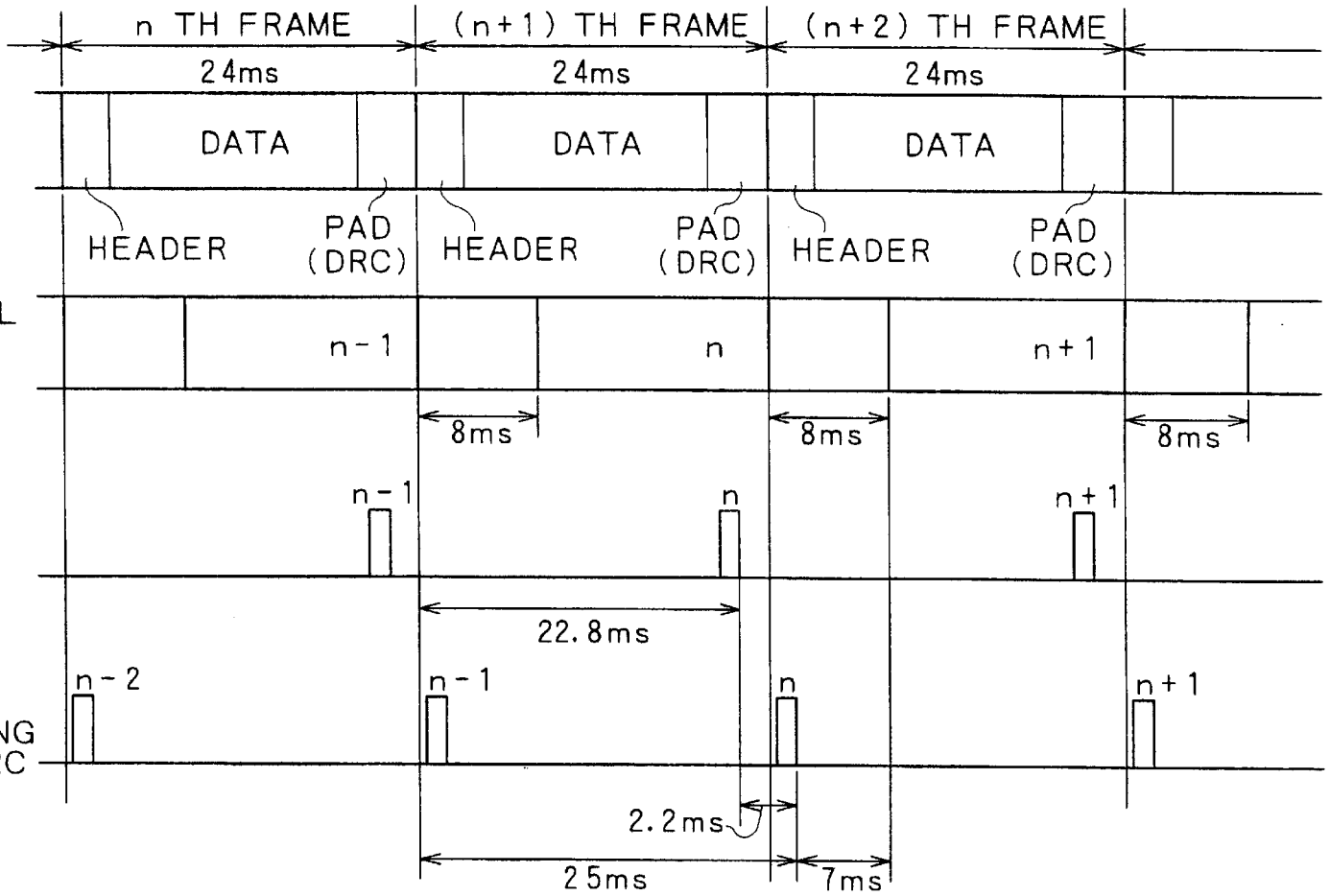
FIG. 4A DAB DATA
FIG. 4B DIGITAL AUDIO DATA
FIG. 4C DRC DATA
FIG. 4D SETTING OF DRC DATA

RECEIVER FOR DIGITAL AUDIO BROADCAST

BACKGROUND OF THE INVENTION

This invention relates to a receiver for a digital audio broadcast.

As a digital audio broadcast, DAB (Digital Audio Broadcasting) which complies with the Eureka 147 standards is carried out in Europe. The DAB prepares a function that a broadcasting station controls the gain of an audio signal line of a DAB receiver.

This function is called DRC (Dynamic Range Control). In order to realize the DRC, a broadcasting station adds control data called DRC data to original digital audio data and sends out resulting data.

FIG. 4A shows a structure of DAB data in one service transmitted by the DAB. Referring to FIG. 4A, the DAB data is formed by a plurality of frames. A header is disposed at the top of each frame, and audio data and data of a SCF (SCale Factor) and so forth are disposed following the header. The audio data is data (hereinafter referred to as MPEG audio data) obtained by compressing original linear digital audio data in accordance with the layer II of the MPEG audio standards, and the SCF is a scale factor used upon such data compression.

Further, an area called PAD (Program Associated Data) is prepared at the last of the frame, and DRC data is disposed at part of the PAD. In this instance, however, if the arbitrary frame is the nth frame, then the DRC data of the nth frame is defined as being effective on digital audio data on the next (n+1)th frame.

For example, in the mode II, the frame period is 24 milliseconds, and accordingly, also DRC data is sent out after each 24 milliseconds. Further, the DRC data and the gain of the audio signal line have the following relationship:

| DRC data | gain |
|---|---|
| 000000 | 0 dB (reference gain) |
| 000001 | +0.25 dB |
| 000010 | +0.50 dB |
| 000011 | +0.75 dB |
| . | ←increase by 0.25 dB step |
| . | |
| . | |
| 111111 | +15.75 dB |

Accordingly, if, for example, "000011" is sent as DRC data from a broadcasting station, then the gain of the audio signal line of a DAB receiver increases by 0.75 dB, and as a result, the volume of sound of the DAB receiver becomes greater by 0.75 dB than a sound volume set by its user.

Accordingly, for example, if the sound volume of the DAB receiver is controlled as in AGC with DRC data while a news program is on the air, then the articulation of sound received can be raised. Or in the case of urgent broadcasting, the sound volume of the DAB receiver can be increased compulsorily so that the listener can hear the urgent broadcast with certainty.

However, development of a DAB receiver conducted with a conventional technique has revealed that a displacement in time occurs in gain control with DRC data.

In particular, since, in the DAB, digital audio data and DRC data are processed in a unit of a frame, when a DAB receiver extracts MPEG audio data from DAB data of FIG. 4A and decodes them into digital audio data, the digital audio data is obtained, for example, after 8 milliseconds from the starting point of time of a next frame as seen from FIG. 4B.

Further, when data of a PAD of the DAB data of FIG. 4A is analyzed to extract DRC data, the DRC data is obtained, for example, after 22.8 milliseconds from the starting point of time of a next frame as seen also from FIG. 4C.

The DAB receiver multiplies the digital audio data by the DRC data to perform gain control. Thus, before the DRC data is set to the multiplication circuit, a time of, for example, 2.2 milliseconds is required as seen in FIG. 4D.

Accordingly, where the numerical value examples given above apply, a time difference of, for example, 7 milliseconds appears between the digital audio data and the DRC data set to the multiplication circuit as seen from FIGS. 4B and 4D. In this instance, since the DRC data of a certain frame corresponds to the digital audio data of the next frame, the sound volume control with the DRC data is executed earlier by, for example, 7 milliseconds than the original time.

The time difference between the digital audio data and the DRC data is different depending upon the design of the circuit, and in some cases, the digital audio data may possibly be obtained later than the DRC data.

The time difference between the digital audio data and the DRC data can be corrected by calculating times required for signal processing of the individual data and delaying one of the data in accordance with the calculated values. However, since the signal processing for the individual data is complicated, the time difference cannot be discriminated accurately.

Accordingly, a time difference appears between the digital audio data and the DRC data as described above, and sound volume control with the DRC data is displaced in time.

SUMMARY OF THE INVENTION

It is an object of the present invention to provide a receiver for a digital audio signal by which the timings of digital audio data and DRC data in a DAB receiver can be adjusted to prevent displacement in time of sound volume control with the DRC data.

In order to attain the object described above, according to the present invention, there is provided a receiver for a digital audio broadcast for receiving a digital audio broadcast by which digital audio data and control data incidental to the digital audio data are sent out, comprising a reception circuit for receiving the digital audio broadcast, a decoder circuit for extracting the digital audio data and the control data from a signal received by the reception circuit, a D/A converter circuit for performing D/A conversion of the digital audio data extracted by the decoder circuit into an analog audio signal and outputting the analog audio signal, control means for controlling a characteristic of the analog audio signal in accordance with the control data extracted by the decoder circuit, and a memory into which that one of the digital audio data and the control data which has been extracted at an earlier timing by the decoder circuit is written, the control means successively varying a write address for the memory in a sampling period of the digital audio data while the control means successively reading out the data written in the memory with a read address having a predetermined address difference from the write address and uses the data thus read out to execute control of the characteristic of the analog audio signal with the control data extracted by the decoder circuit.

In the receiver for a digital audio broadcast, the time difference between digital audio data and control data for the digital audio data can be corrected with the memory. In this instance, even if signal processing for the digital audio data and the DRC data is complicated and the time required for the signal processing cannot be calculated accurately, the time difference between the digital audio data and the DRC data can be corrected accurately.

Besides, the time difference between the digital audio data and the DRC data can be corrected with a resolution of one sample period of the digital audio data. Further, even if the digital audio data have a plurality of sampling periods, the receiver for a digital audio broadcast can cope with this simply. Furthermore, whichever one of timings of the digital audio data and the control data is delayed, the receiver for a digital audio broadcast can cope with this.

The above and other objects, features and advantages of the present invention will become apparent from the following description and the appended claims, taken in conjunction with the accompanying drawings in which like parts or elements denoted by like reference symbols.

BRIEF DESCRIPTION OF THE DRAWINGS

FIGS. 4A to 4D are waveform diagrams: illustrating operation of the receiver for a digital audio signal of FIG. 1.

DESCRIPTION OF THE PREFERRED EMBODIMENT

Figure 1:
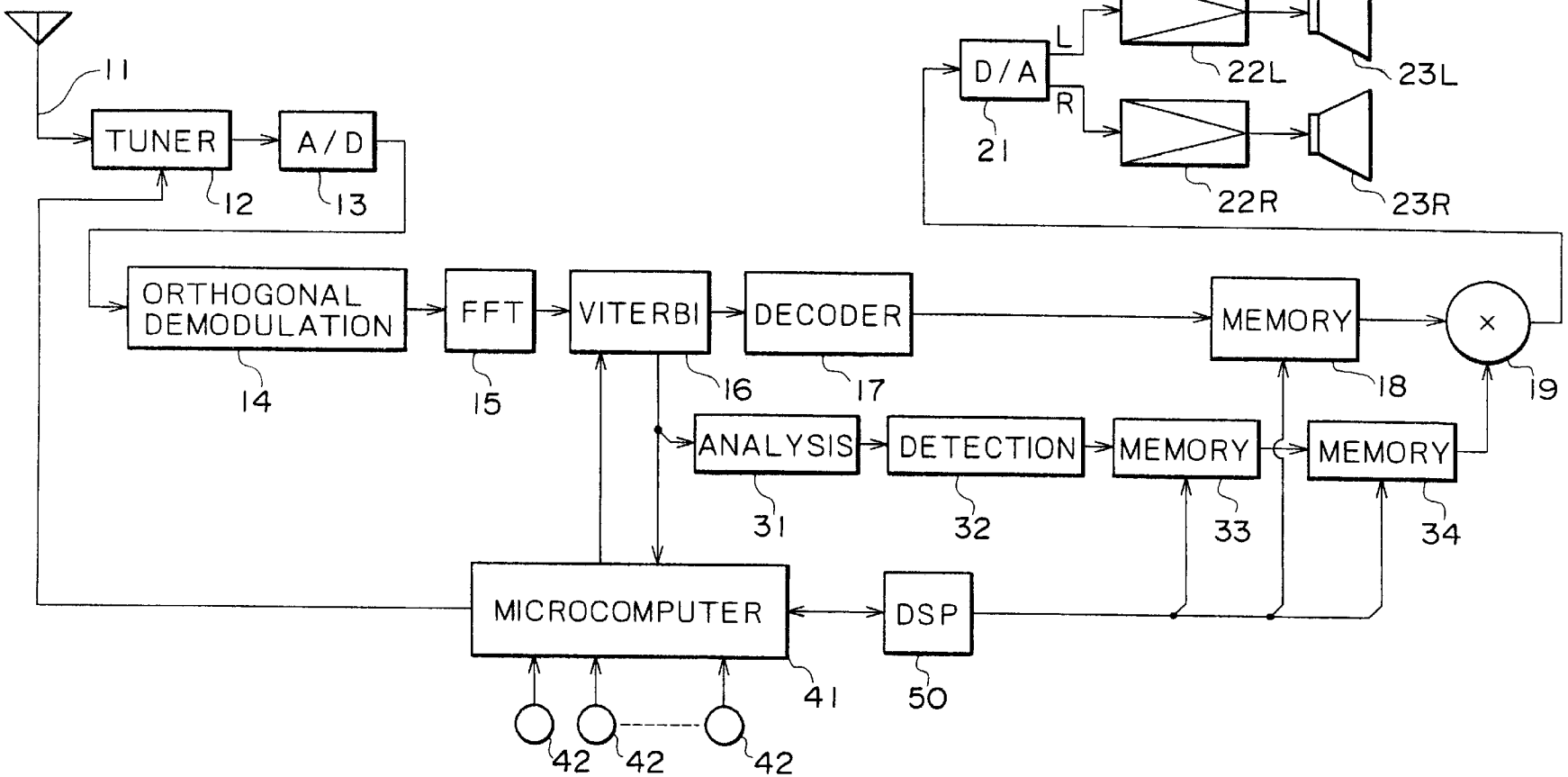
FIG. 1 is a block diagram showing a receiver for a digital audio signal to which the present invention is applied.

Referring first to FIG. 1, there is shown a receiver for a digital audio signal to which the present invention is applied. In the receiver for a digital audio signal shown, a broadcasting wave signal of the DAB is received by an antenna 11, and the reception signal is supplied to a tuner circuit 12. The tuner circuit 12 is formed as of the superheterodyne type including a PLL. The reception frequency of the tuner circuit 12 can be varied by varying the dividing ratio of a variable frequency dividing circuit of the PLL. A baseband signal of the DAB is extracted by the tuner circuit 12 and supplied to an A/D converter circuit 13. The A/D converter circuit performs A/D conversion to convert the baseband signal into a digital signal.

The digital signal is supplied to an orthogonal demodulation circuit 14, by which data of a common mode component (real axis component) and an orthogonal component (imaginary axis component) of the digital signal are demodulated. Complex Fourier transform is performed for the demodulated data by a fast Fourier transform (FFT) circuit 15, and resulting frequency components are outputted for each symbol from the FFT circuit 15. The output of the FFT circuit 15 is supplied to a Viterbi decoder circuit 16, by which deinterleave and error correction are performed for the received data and MPEG audio data of a target service component is selected from within data obtained by the deinterleave and error correction.

Then, the selected data is supplied to an MPEG decoder circuit 17, by which decoding processing of the data such as MPEG data decompression is performed. Then, digital audio data of an object program are extracted by the MPEG decoder circuit 17. It is to be noted that the digital audio data is, for example, a signal of a timing illustrated in FIG. 4B.

Then, the digital audio data is supplied to a memory 18, by which they are delayed by a predetermined interval TA. The delayed digital audio data is supplied to a multiplication circuit 19. The multiplication circuit 19 is provided in order to multiply the digital audio data by DRC data to realize the DRC, and digital audio data for which gain control according to the DRC has been executed are extracted by the multiplication circuit 19.

Then, the digital audio data is supplied to a D/A converter circuit 21, by which they are D/A converted into analog audio signals L and R. The signals L and R are supplied to speakers 23L and 23R through amplifiers 22L and 22R, respectively.

Further, data of a PAD from the Viterbi decoder circuit 16 is supplied to an analysis circuit 31, by which the DRC data is analyzed. A result of the analysis is supplied to a DRC detection circuit 32, by which the DRC data is extracted. It is to be noted that the DRC data is a signal of a timing, for example, illustrated in FIG. 4C.

Since the DRC data is given for each frame as described above, it is written in a frame period into the memory 33 and read out from the memory 33 in a sampling period of the digital audio data so that it is given for each sampling period of the digital audio data. The DRC data of the sampling period is supplied to a memory 34 and delayed by a predetermined period TB by the memory 34, and the delayed DRC data is supplied to the multiplication circuit 19.

In this instance, the delay time TA by the memory 18 and the delay time TB by the memory 34 are set to predetermined values so that a time difference between the digital audio data and the DRC data at the multiplication circuit 19 may be eliminated. In particular, where the numerical value examples given hereinabove apply, the delay time TA and the delay time TB are set to $$TB=7 \text{ milliseconds}, TA=0$$

so that $$TB-TA=7 \text{ milliseconds}$$

may be satisfied.

Further, a microcomputer 41 is provided for controlling the system, and as frequency data for selecting an ensemble, data of a dividing ratio of the variable frequency dividing circuit of the PLL of the tuner circuit 12 is supplied from the microcomputer 41 to the tuner circuit 12.

Further, data necessary for identification or specification of a service and a service component are extracted by the Viterbi decoder circuit 16 and supplied to the microcomputer 41. Further, a selection signal is supplied from the microcomputer 41 to the Viterbi decoder circuit 16 so that a service is selected and MPEG audio data of a target service component is selected from within the selected service by the Viterbi decoder circuit 16.

Further, various operation keys 42 are connected to the microcomputer 41, and also a DSP (Digital Signal Processor) 50 is connected to the microcomputer 41. The microcomputer 41 and the DSP 50 cooperatively serve as control means. The DSP 50 controls writing/reading out for the memories 18 and 34 and addresses therefor to acquire the delay times TA and TB described hereinabove. Therefore, where contents of processing of the DSP 50 are represented as hardware, they are such, for example, as shown in FIG. 2.

Figure 2:
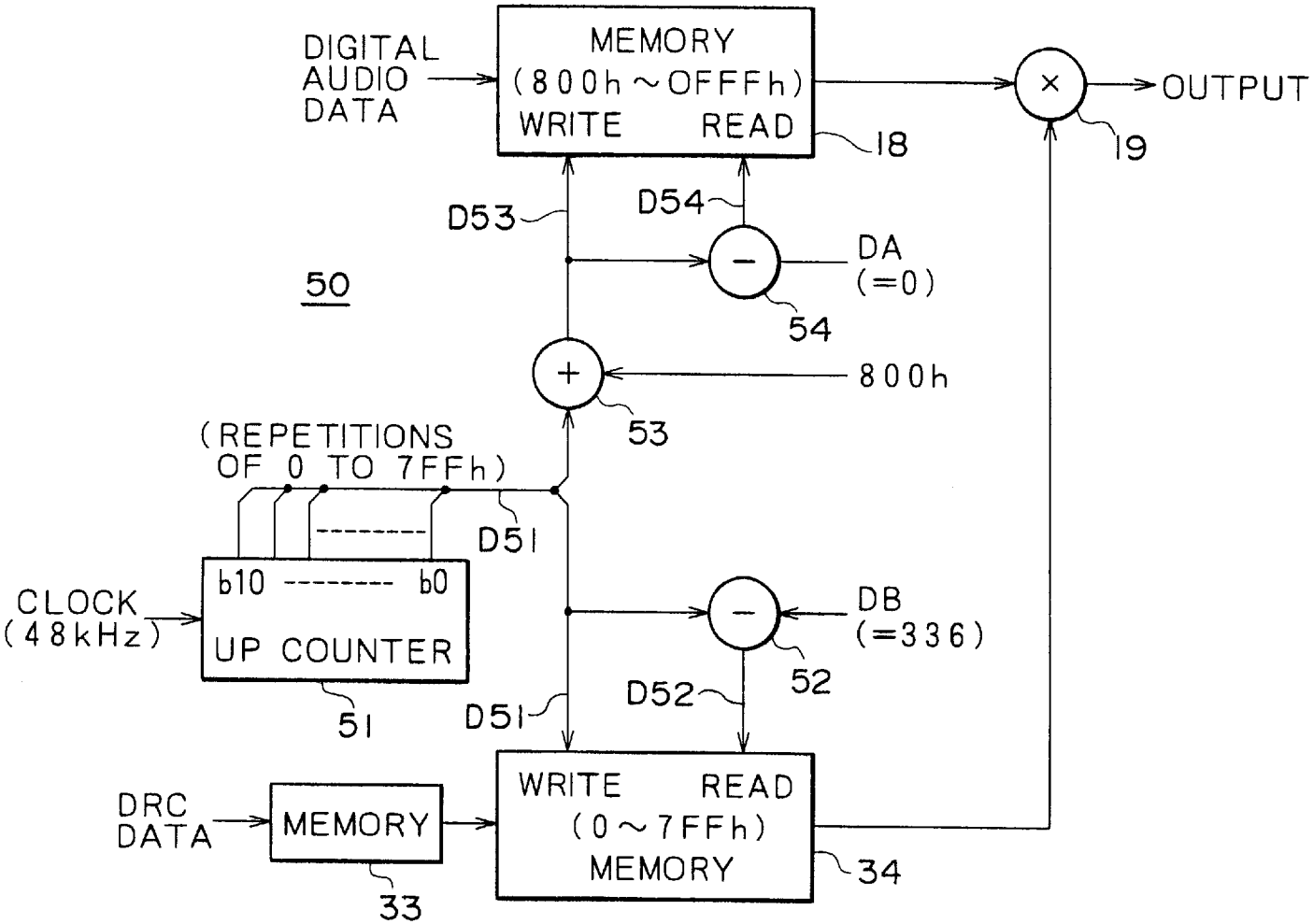
FIG. 2 is a block diagram showing a detailed circuit construction of part of the receiver for a digital audio signal of FIG. 1.

In particular, referring to FIG. 2, it is assumed for simplified description that the memories 18 and 34 can execute writing and reading out operations thereof simultaneously and can perform setting of write addresses and read addresses simultaneously with and independently of each other. Further, it is assumed that, the memories 18 and 34 have addresses from 0 to 0FFFh (h represents the hexadecimal notation). It is to be noted that, although the reason becomes clear from the description given below, the memory 18 uses the addresses 800 h to 0FFFh while the memory 34 uses the address, 0 to 7FFh from within the entire address area.

The digital audio data from the MPEG decoder circuit 17 are supplied to the memory 18. Further, the DRC data from the DRC detection circuit 32 is written in a period of a frame into a memory 33 and then read out in a sampling period of the digital audio data from the memory 33 to obtain DRC data for each sampling period. The DRC data is supplied to the memory 34.

Further, an eleven-bit up counter 51 is provided. To the up counter 51, a clock signal of the sampling period of the digital audio data, for example, of a frequency of 48 kHz, is supplied together with a counting input. Accordingly, the count value D51 of the up counter 51 is successively incremented by "1" after each 1 sample period of the digital audio data and successively varies between 0 and 7FFH.

The count value D51 is supplied as a write address to the memory 34. The count value D51 is supplied also to a subtraction circuit 52 while data DB of a predetermined value is supplied to the subtraction circuit 52 so that the data DB is subtracted from the count value D51. Thus, a subtraction result D52 (=D51−DB) is supplied as a read address from the subtraction circuit 52 to the memory 34. It is to be noted that, when (D51−DB)<0, the read address D52 is equal to a sum of the difference address value (D51−DB) and the address value 800 h.

Here, the data DB is a sample number of the digital audio data within the period TB, and where the numerical value examples given hereinabove apply, the data DB is given as $$DB=7 \text{ milliseconds}/(1/48 \text{ kHz})=336$$

Accordingly, the write address D51 and the read address D52 for the memory 34 are successively incremented by one address value for each one sampling period of the digital audio data and repetitively varies between the addresses 0 and 7FFh. Further, in this instance, the read address D52 is smaller by the value DB than the write address D51.

A write signal and a read signal are supplied to the memory 34 after each sampling period of the digital audio data.

Figures 3A, 3B:
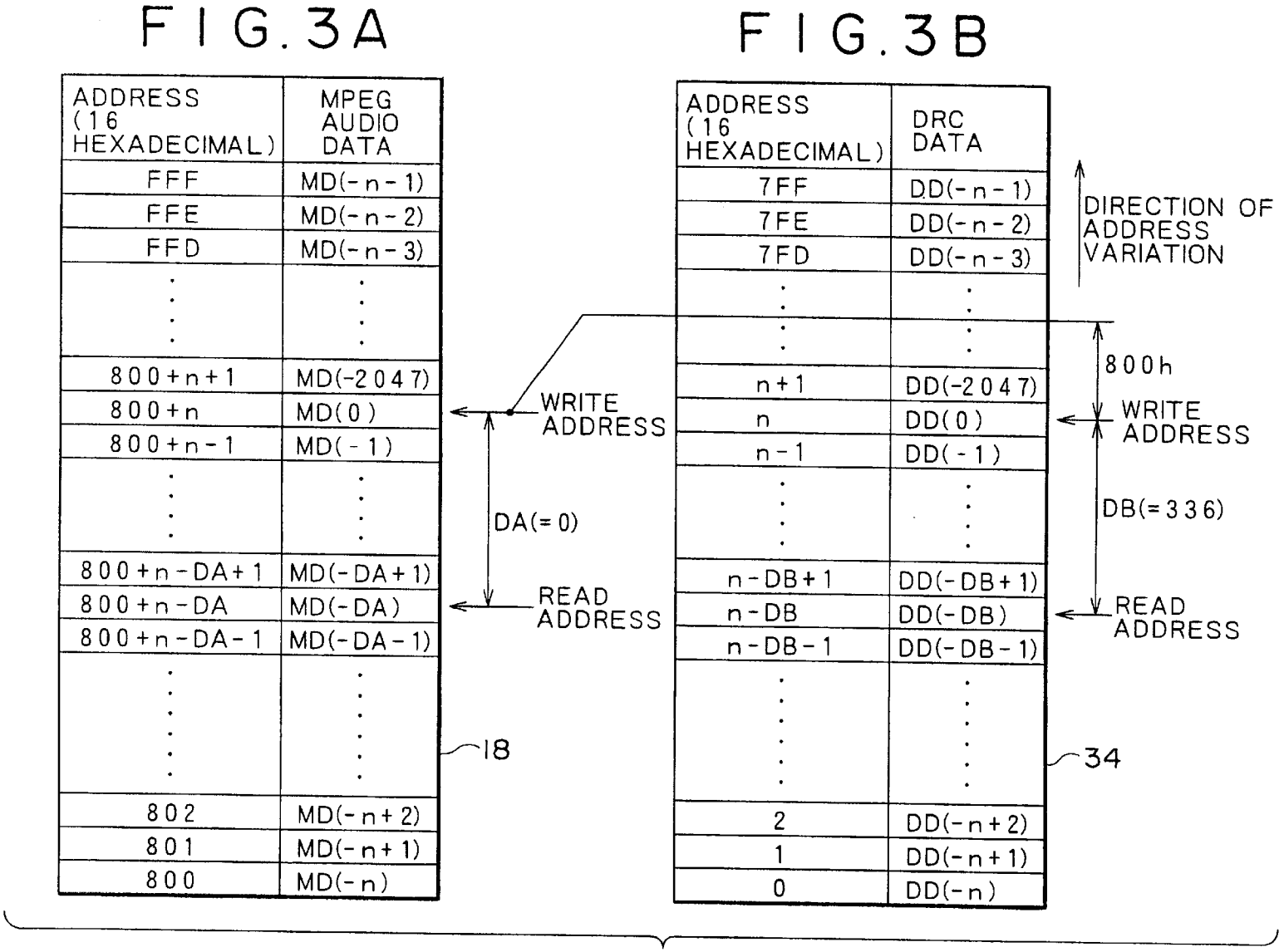
FIGS. 3A and 3B are diagrammatic views illustrating writing and reading out operations for a memory of the receiver for a digital audio signal of FIG. 1.

Accordingly, the relationship between writing and reading out for the memory 34 is such as illustrated in FIG. 3B. Referring to FIG. 3B, within a certain sampling period of the digital audio data, DRC data DD(0) at the point of time is written into the address n of the memory 34 while DRC data DD(−DB) is read out from another address (n−DB) smaller by the DE address value than the address n.

Since the write address and the read address for the memory 34 are incremented by one for each sampling period of the digital audio data, DRC data DD(−DB) read out from the address (n−DB) is data in the past prior by a time corresponding to the value DB with respect to the current point of time, or in other words, data delayed by the period corresponding to the value DB.

Since the value DB then is a sample number of the digital audio data for the period TB, the delay time corresponding to the value DB is the time TB.

Accordingly, the DRC data delayed by the delay time TB is outputted from the memory 34. Where the numerical value examples given hereinabove apply, the DRC data delayed by TB=7 milliseconds is extracted The DRC data is set as control data for the gain to the multiplication circuit 19.

Further, the count value D51 of the counter 51 is supplied to an addition circuit 53 while a fixed value 800 h is supplied to the addition circuit 53, and data D53 given by $$D53=D51+800 \text{ h}$$

is extracted by the addition circuit 53. The data D53 is supplied as a write address to the memory 18. The data D53 is supplied also to a subtraction circuit 54 while data DA of a predetermined value is supplied to the subtraction circuit 54 and subtracted from the data D53 by the subtraction circuit. A subtraction result D54 (=D53−DA) then is supplied as a read address to the memory 18.

Here, the data DA is a sample number of the digital audio data within the period TA and is, where the numerical value examples given hereinabove apply, given by $$DA=0/(1/48 \text{ kHz})=0$$

Further, a write signal and a read signal are supplied to the memory 18 after each sampling period of the digital audio data.

Accordingly, writing into and reading out from the address area 800 h to 0FFFh of the memory 18: similar to those for the memory 34 are executed as seen in FIG. 3A, and MPEG audio data delayed by the period TA is outputted from the memory 18. Where the numerical value examples given hereinabove apply, TA=0. Therefore, the MPEG audio data which has not been delayed is extracted. Then, the MPEG audio data is supplied to the multiplication circuit 19.

Accordingly, where the numerical value examples given hereinabove apply, $$TB-TA=7 \text{ milliseconds}$$

and, the time difference between the digital audio data and the DRC data is eliminated at the multiplication circuit 19.

It is to be noted that the data DB and DA can be determined in the following manner. In particular, some DAB station broadcasts a service having digital audio data of an audio signal which exhibits, for example, a burst condition when it undergoes D/A conversion and DRC data which varies at the starting point of time of the audio signal in the burst condition in order to adjust the time difference between the digital audio data and the DRC data.

Thus, upon actual manufacture of a product, a testing receiver which performs the same processing as the product but satisfies the relationship TB=TA (DB=DA) is prepared, and the service for time difference adjustment is received by the testing receiver to measure the time difference between digital audio data and DRC data.

Then, the data DB and DA are determined so that the difference value (TB−TA) may be equal to the measured time difference, and the data DB and DA thus determined are incorporated into the product receiver.

Where the product receiver is produced in this manner, the time difference between digital audio data and DRC data can be eliminated as described above.

In this manner, with the DAB receiver described above, the time difference between digital audio data and DRC data does not appear, and accordingly, sound volume control with DRC data is not displaced in time.

In this instance, however, even if signal processing for digital audio data and DRC data is complicated and the time required for the signal processing cannot be calculated accurately, the time difference between the digital audio data and the DRC data can be corrected accurately.

Besides, when the data DA and DB vary by the magnitude of "1", since digital audio data or DRC data is delayed by one sample period of the digital audio data, the time difference between the digital audio data and the DRC data can be corrected with a resolution of one sample period.

Further, even if the sampling period of the digital audio data varies, for example, to 44.1 kHz, the receiver for a digital audio broadcast can simply cope with this only by varying the data DB (and DA). Furthermore, also where the digital audio data is delayed with respect to the DRC data, the receiver for a digital audio broadcast can cope with this by setting the data DA and DB to certain values which satisfy the relationship DA>DB.

It is to be noted that, while, in the foregoing description, it is assumed for simplified description that writing into and reading out from the memories 18 and 34 can be executed simultaneously and write addresses and read address can be set simultaneously with and independently of each other, where memories, which do not allow such operations as just described are used, writing of data should be performed within the former half of one sample period of digital audio data whereas reading out is performed within the latter half of the one sample period.

Further, since the memory 18 uses the addresses 800 h to 0FFFh and the memory 34 uses the addresses 0 to 7FFh of the entire address area, it is otherwise possible to form the memory 18 and the memory 34 as a common memory and perform writing and reading out processing for the memory 18 within the former half of one sample period of the digital audio data whereas writing and reading out processing for the memory 34 is performed within the latter half of the one sample period.

Further, since the actual DSP 50 controls writing and reading out for the memories 18 and 34 by software processing, it is also possible to form the memories 18 and 34 as a common memory and divide one sample period of digital audio data such that writing and reading out for the memory 18 and writing and reading out for the memory 34 are executed in a time divisional relationship in the divisional periods.

Furthermore, while the foregoing description relates to a case wherein the time difference between digital audio data and DRC data of the DAB is corrected, the present invention can be applied otherwise to a case wherein the time difference between digital audio data and control data incidental to the digital audio data is corrected such as a case wherein, for example, the time difference between digital audio data and control data for an emphasis characteristic is corrected.

Further, while the foregoing description relates to a case wherein the multiplication circuit 19 is provided in the signal line for digital audio data to effect control of the gain, the gain control may be performed otherwise on a signal line for an analog audio signal, for example, on the amplifiers 22L and 22R. Also it is possible to orthogonally demodulate an output signal of the tuner circuit 12 to obtain signals of an I component and a Q component, perform A/D conversion for the signals and supply the digital signals to the FFT circuit 15.

While a preferred embodiment of the present invention has been described using specified terms, such description is for illustrative purposes only, and it is to be understood that changes and variations may be made without departing from the spirit or scope of the following claims.

What is claimed is:

1. A receiver for receiving a digital audio broadcast signal including digital audio data and control data incidental to the digital audio data, the receiver comprising:

a reception circuit for receiving a digital audio broadcast signal;

a decoder circuit for extracting digital audio data and control data from the digital audio broadcast signal received by said reception circuit;

a D/A converter circuit for performing D/A conversion of the digital audio data extracted by said decoder circuit for producing an analog audio signal and for outputting the analog audio signal;

control means for controlling a characteristic of the analog audio signal in accordance with the control data extracted by said decoder circuit; and a memory into which a one of the digital audio data and the control data which has been extracted at an earlier time by said decoder circuit is written, wherein said control means successively varies a write address for said memory in a sampling period of the digital audio data while said control means successively reads out the data written in said memory with a read address having a predetermined address different from the write address and uses the data thus read out to execute control of the characteristic of the analog audio signal with the control data extracted by said decoder circuit.

2. The receiver for a digital audio broadcast according to claim 1, wherein said control means includes a multiplication circuit interposed between said decoder circuit and said D/A converter circuit.

3. The receiver for a digital audio broadcast according to claim 2, wherein the control data is dynamic range control data used to control the dynamic range of the analog audio signal, and the data which has been extracted earlier is the dynamic range control data.

* * * * *